US005729877A

United States Patent [19]

Kong et al.

[11] Patent Number: 5,729,877

[45] Date of Patent: Mar. 24, 1998

[54] PINCH RESISTANT BUCKLE ASSEMBLY

[75] Inventors: C. Kwai Kong, Morgan Hill; Thomas K. Geraty, Campbell, both of Calif.; Christopher G. Asplin, Urbana, Ill.

[73] Assignee: Bell Sports, Inc., San Jose, Calif.

[21] Appl. No.: 706,213

[22] Filed: Aug. 30, 1996

[51] Int. Cl.[6] ..... A44B 11/00

[52] U.S. Cl. ..... 24/625; 24/196; 24/616; 24/634

[58] Field of Search ..... 24/625, 633, 634, 24/615, 616, 163 K, 196, 618

[56] References Cited

U.S. PATENT DOCUMENTS

| | | | |
|---|---|---|---|
| D. 341,105 | 11/1993 | Lovato | D11/216 |
| 874,957 | 12/1907 | Godley . | |
| 1,539,744 | 5/1925 | Kelly | 24/163 K |
| 4,662,040 | 5/1987 | Terrell et al. | 24/625 |
| 4,672,725 | 6/1987 | Kasai | 24/625 |
| 4,713,865 | 12/1987 | Geldwerth | 24/616 |
| 4,745,667 | 5/1988 | Conte | 24/615 |
| 4,796,336 | 1/1989 | Scully | 24/196 |
| 4,831,694 | 5/1989 | Kong | 24/625 |
| 4,912,950 | 4/1990 | Crowle | 24/625 |
| 4,991,272 | 2/1991 | Bianchi | 24/616 |
| 5,086,547 | 2/1992 | Ziemelis | 24/616 |
| 5,131,122 | 7/1992 | Lavato | 24/625 |
| 5,144,725 | 9/1992 | Krauss | 24/625 |
| 5,222,279 | 6/1993 | Frano et al. | 24/625 |
| 5,419,020 | 5/1995 | Murai | 24/625 |

FOREIGN PATENT DOCUMENTS 2 262 962 7/1993 United Kingdom .

*Primary Examiner*—Victor N. Sakran
*Attorney, Agent, or Firm*—Rhodes Coats & Bennett, L.L.P.

[57] ABSTRACT

The present invention is directed to a pinch resistant buckle assembly to reduce the potential for pinching the skin of a person when connecting a female receptacle and a male latch of the assembly. The male latch has an outwardly extending engagement portion which is received by a female receptacle. The female receptacle has a body having a chamber adapted to releasably engage the engagement portion of the male latch. The chamber has an opening at the engagement end of the female receptacle body through which the engagement portion of the latch passes to engage the chamber.

A guide shield is located adjacent the opening and extends substantially away from the opening in a direction from which the male latch is inserted. Extending the shield outwardly away from the opening effectively enlarges the area of the opening by providing a larger effective area to guide the engagement portion of the male latch into the opening. The guide shield provides an extended surface leading into the chamber through the opening. Instead of placing the engagement portion exactly into the opening, during connection the user need only place the engagement portion somewhere along the guide shield surface and slide the engagement portion through the opening and into the chamber for engagement. The guide shield greatly reduces the risk of pinching by virtually eliminating the blunt end of the female receptacle and providing an area to guide the engagement portion into the chamber.

23 Claims, 6 Drawing Sheets

PINCH RESISTANT BUCKLE ASSEMBLY

BACKGROUND OF THE INVENTION

The present invention relates to a releasable buckle assembly having a female receptacle and a corresponding male latch, and more particularly to an assembly wherein the female receptacle includes an outwardly extending guide shield to aid in directing the male latch into releasable engagement with the female receptacle. The guide shield significantly reduces the potential for pinching skin while engaging the female receptacle and the male latch of the buckle assembly.

Buckle assemblies are know which have a female receptacle connector and a corresponding male latch connector wherein both connectors have a free end connected to a strap, belt or the like to facilitate connection to the straps. The male latch includes an outwardly extending engagement portion configured to releasably engage a corresponding chamber within the female receptacle. The receptacle and latch cooperate to allow release of the male latch from the female receptacle upon actuation of a release portion or the like associated with either the male latch or female receptacle.

Given the tremendous increase in outdoor sporting activities and the various safety concerns and protections associated therewith, the use of buckles has likewise increased. Many of these buckles make direct contact with skin during use or are separated from skin with only a thin material. For example, protective headgear, such as bicycle helmets, use buckles to strap the headgear in the headgear in place. The buckle assembly is often connected while in proximity to a wearer's skin. Currently available buckles sometimes cause a wearer to pinch him or herself when attempting to engage the male latch and female receptacle because the female receptacle typically has a relatively blunt end portion into which the engagement portion of the male latch is inserted. The skin is pinched between the blunt end and the engagement portion of the latch, when the user blindly connects the male latch and the female receptacle. The potential for pinching is increased because the user is unable to view the connecting operation occurring beneath his or her chin, and the straps are typically relatively tight to insure the headgear is secure.

Currently available buckles are uncomfortable, particularly during long periods of use. The buckles are generally rectangular and flat and therefore fail to evenly distribute pressure over the curving contours on which they lay. Examples of available buckles and buckle assemblies are shown in U.S. Pat. No. 5,222,279 to Frano et al., U.S. Pat. No. 5,144,725 to Krauss, U.S. Des. Pat. No. 341,105 to Lovato and U.K. Patent Application No. 2,262,962 are recent examples of the current trends in buckle technology. These references are exemplary of the current state-of-the-art and the absence of pinch protection measures or contours that add to user comfort.

Thus, there remains a need for a new and improved buckle assembly which significantly reduces the risk of pinching oneself while engaging the male latch and female receptacle in close proximity with one's skin and, at the same time, increase the user's comfort level when the buckle is in direct contact with oneself during use.

SUMMARY OF THE INVENTION

The present invention is directed to a pinch resistant buckle assembly to reduce the potential for pinching the skin of a person when connecting a female receptacle and a male latch of the assembly. The male latch has an outwardly extending engagement portion which is received by a female receptacle. The female receptacle has a body having a chamber adapted to releasably engage the engagement portion of the male latch. The chamber has an opening at the engagement end of the female receptacle body through which the engagement portion of the latch passes to engage the chamber.

A guide shield is located adjacent the opening and extends substantially away from the opening in a direction from which the male latch is inserted. Extending the shield outwardly away from the opening effectively enlarges the area of the opening by providing a larger effective area to guide the engagement portion of the male latch into the opening. The guide shield provides an extended surface leading into the chamber through the opening. Instead of placing the engagement portion exactly into the opening, during connection the user need only place the engagement portion somewhere along the guide shield surface and slide the engagement portion through the opening and into the chamber for engagement. The guide shield greatly reduces the risk of pinching by virtually eliminating the blunt end of the female receptacle and providing an area to guide the engagement portion into the chamber.

The guide shield may include opposing side walls extending substantially perpendicular along the edges of the guide shield from an area adjacent to the opening of the body to provide a channel to guide the engagement portion into the opening. The guide shield may also gradually curve downwardly away from the plane of engagement formed by the female receptacle and male latches to provide a greater effective area of contact leading to the opening in the female receptacle.

Preferably, the female receptacle, guide shield, or both have a surface contoured to comfortably fit along a surface of the human body to increase comfort during use.

Female receptacles 12 having a generally rectangular cross-section may have a bottom side extending outwardly from the body to form the guide shield and oppose sides extending from the body along the edges of the guide shield to form the side walls. The guide shield with side walls forms a generally C-shaped boundary for the channel for guiding the engagement portion of the male latch.

Preferably, the guide shield widens as it extends away from the body of the female receptacle to provide a converging path for pre-engagement of the male latch and female receptacle. These and other aspects of the present invention will become apparent to those skilled in the art after reading the following description of the preferred embodiment when considered with the drawings.

DESCRIPTION OF THE PREFERRED EMBODIMENTS

Figure 1:
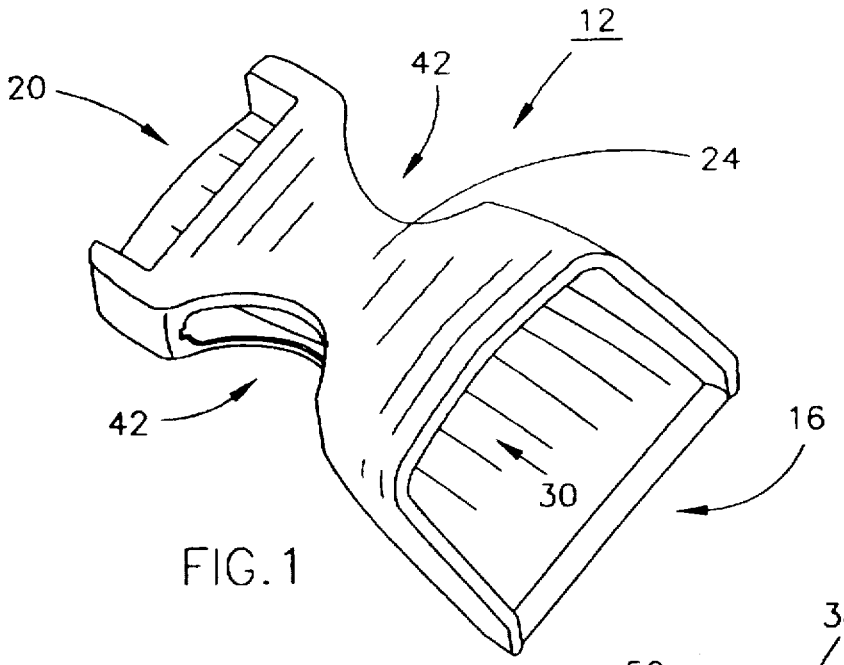
FIG. 1 is a perspective view of a female receptacle of a buckle assembly constructed according to the present invention.

In the following description, like reference characters designate like or corresponding parts throughout the several views. Descriptive terms used throughout the description are words of convenience and should not be construed to limit the scope of the invention disclosed herein.

The preferred embodiment of the buckle assembly of the invention is generally designated 10 throughout FIGS. 13–18 and includes two primary members: a female receptacle 12, as shown in isolation in FIGS. 1–6 and a male latch 14, as shown in isolation in FIGS. 7–12. The female receptacle 12 and male latch 14 are configured to releasably engage one another at respective engagement ends 16 and 18 in order to releasably connect straps, belts, webbing or the like attached at opposite free ends 20 and 22, respectively. The straps or webbing are connected to the free ends of the female receptacle 12 and male latch 14 through elongated apertures provided for attachment and adjustment of the straps or webbing in conventional fashion. The preferred embodiments of the female receptacle 12 and male latch 14 engage one another as shown in FIGS. 13–18.

Figure 2:
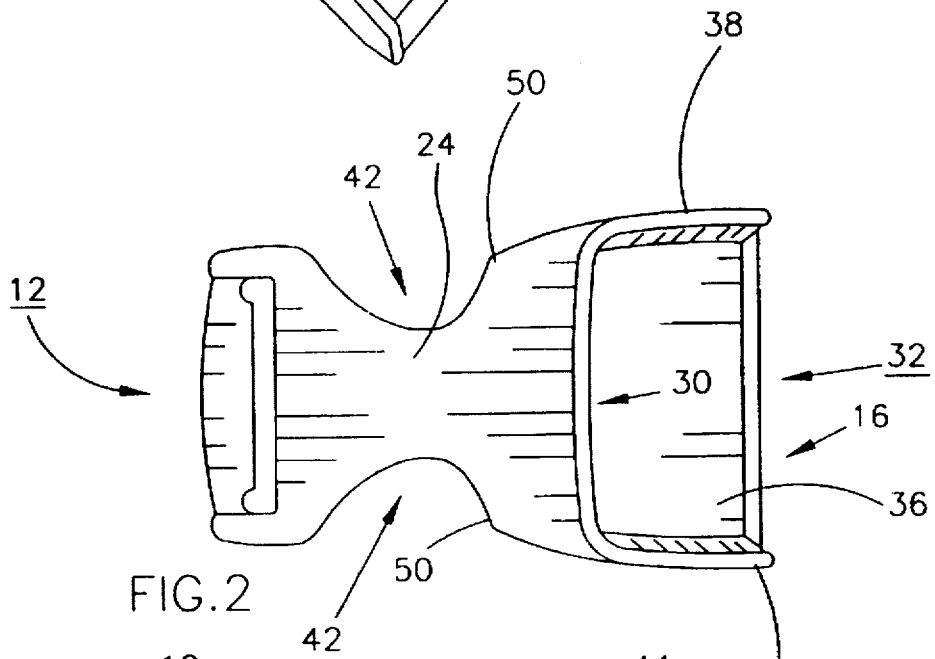
FIG. 2 is a top view of the female receptacle depicted in FIG. 1.
Figure 3:
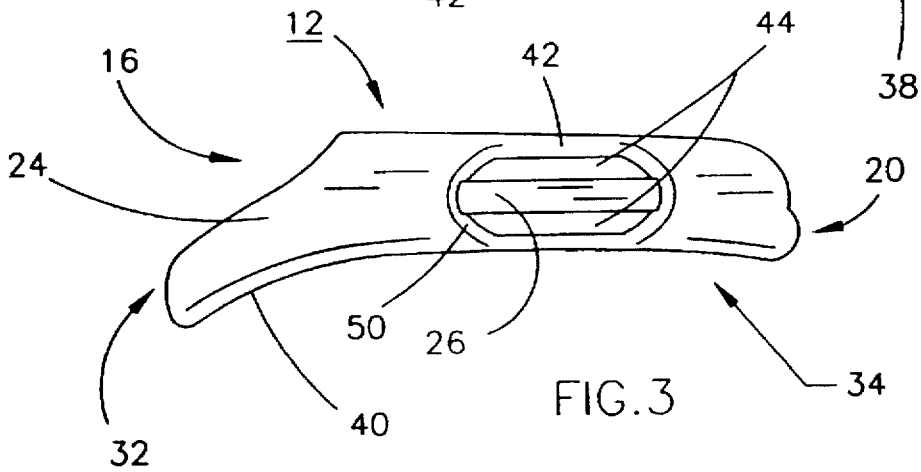
FIG. 3 is a side view of the female receptacle depicted in FIG. 1.
Figure 4:
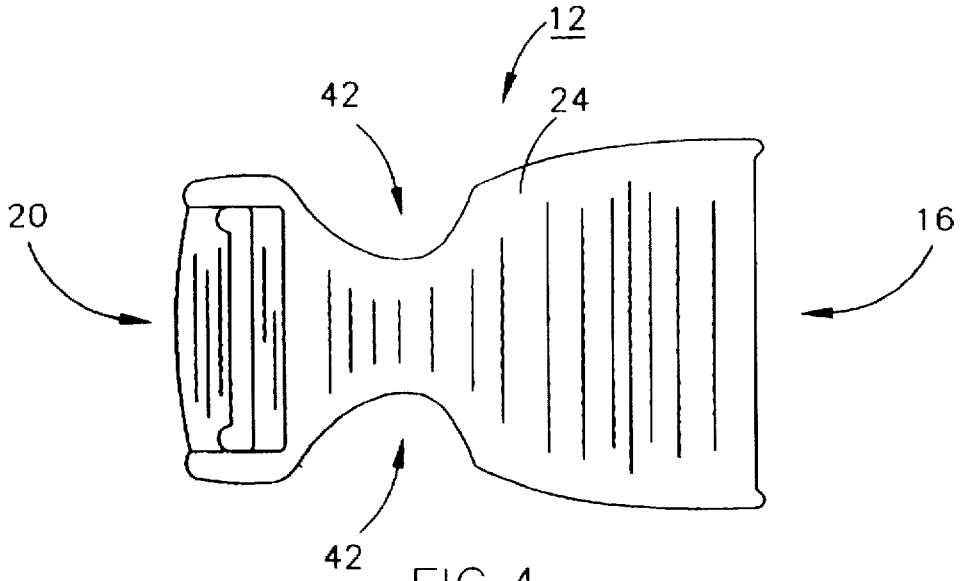
FIG. 4 is a bottom view of the female receptacle depicted in FIG. 1.
Figure 5:
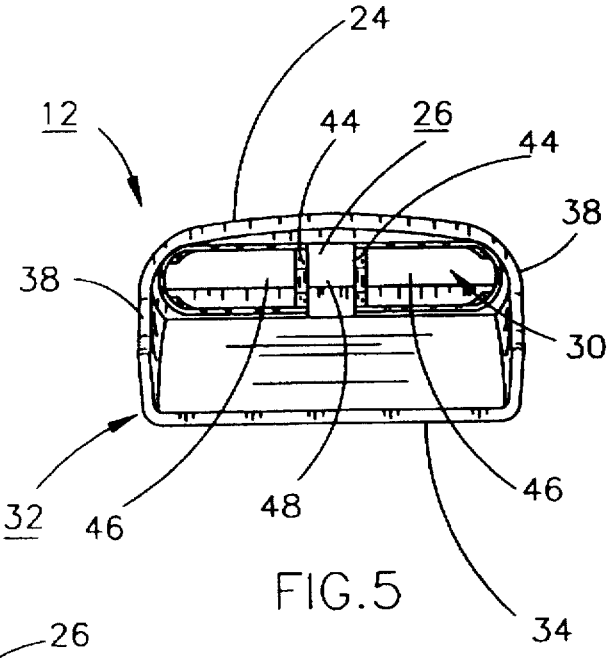
FIG. 5 is an engagement end view of the female receptacle depicted in FIG. 1.
Figure 6:
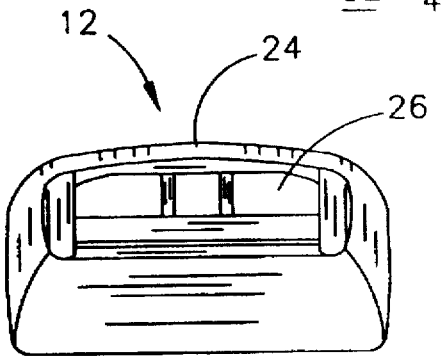
FIG. 6 is a free end view of the female receptacle depicted in FIG. 1.
Figure 7:
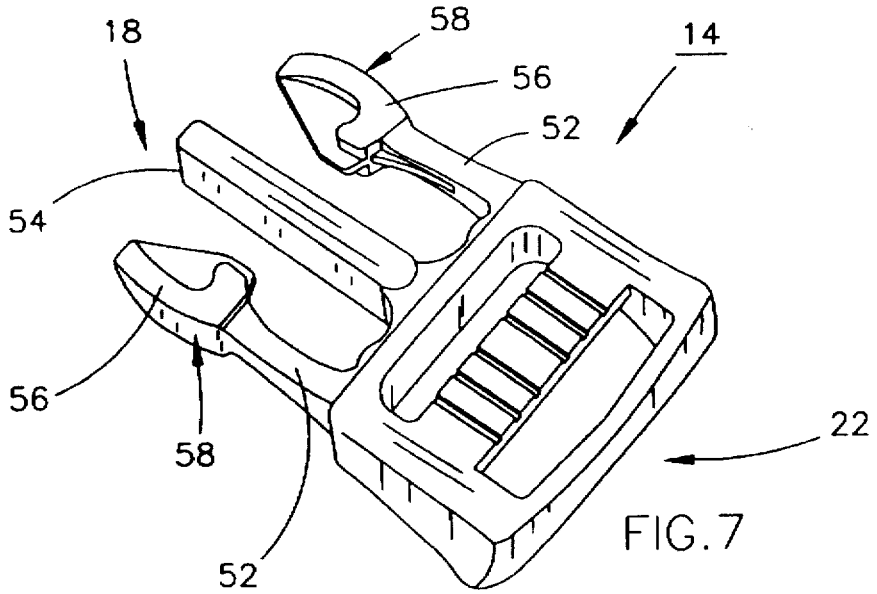
FIG. 7 is a perspective view of a male latch of a buckle assembly constructed according to the present invention.

As best seen in FIGS. 1–6, the female receptacle has a body 24 which increases in width from the free end 20 to the engagement end 16 (as shown in FIG. 2). The body 24 has a generally flat, rectangular cross section (as shown in FIGS. 3 and 5). The body 24 also includes an interior chamber 26 opened at the engagement end 16 to form an end chamber opening 30.

Figure 8:
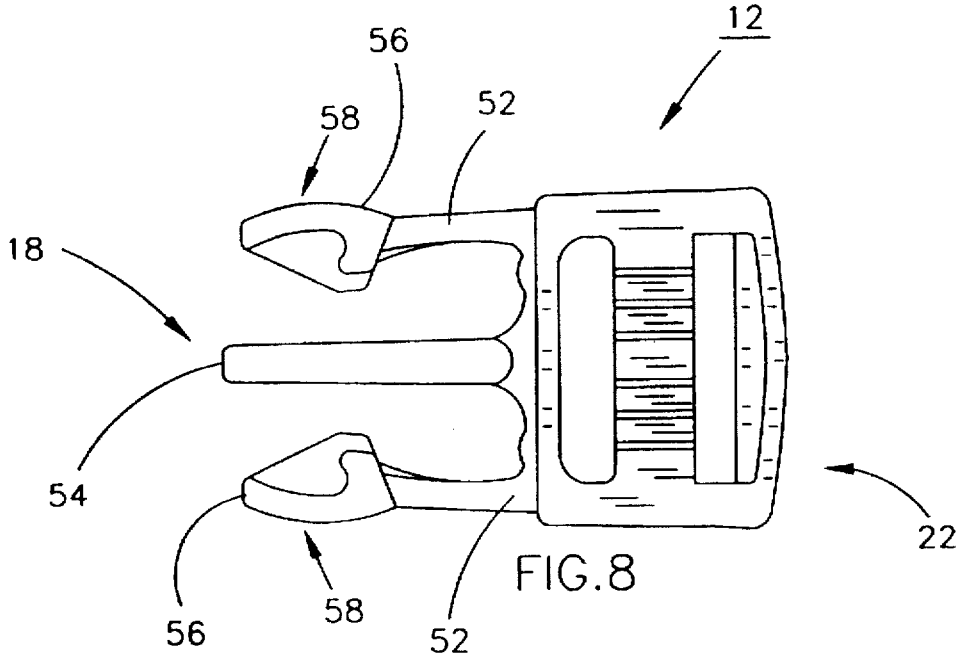
FIG. 8 is a top view of the male latch depicted in FIG. 7.
Figure 9:
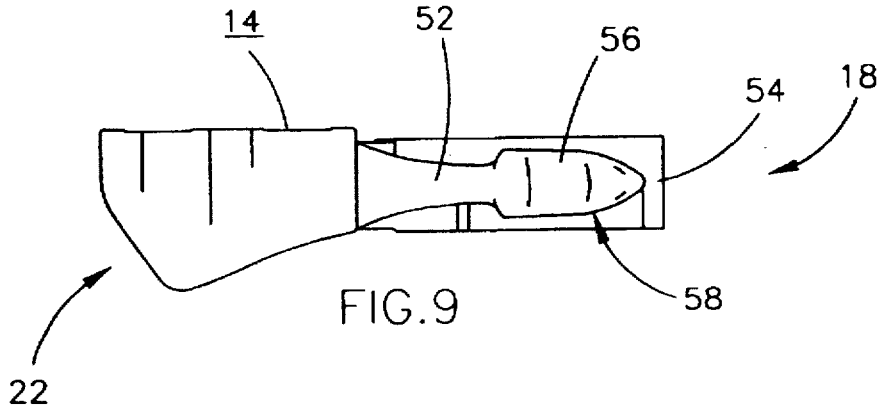
FIG. 9 is a side view of the male latch depicted in FIG. 7.
Figure 10:
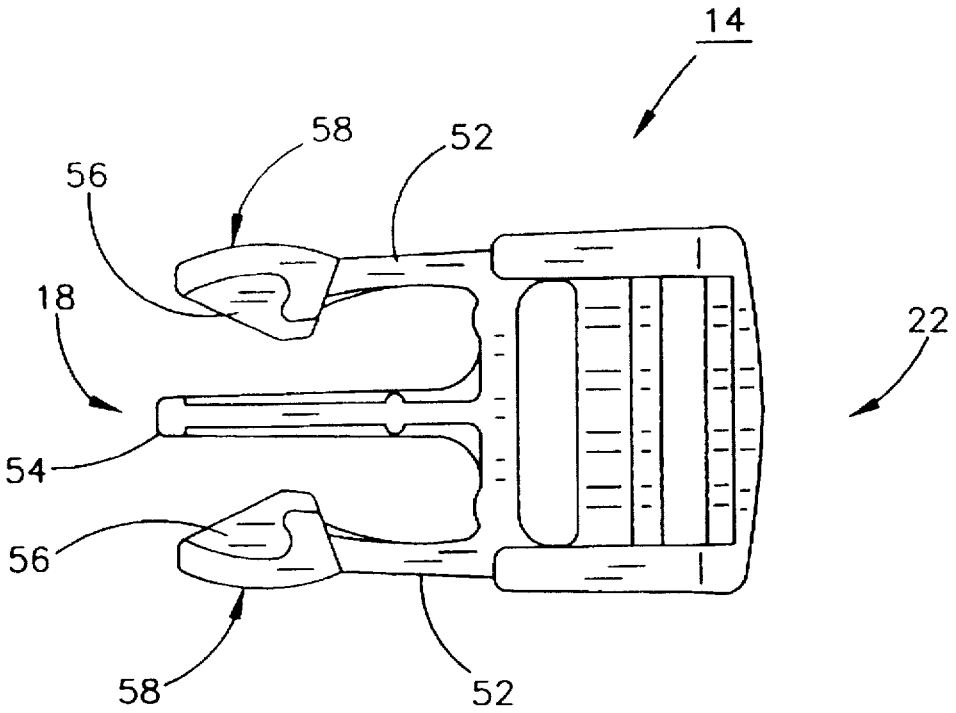
FIG. 10 is a bottom view of the male latch depicted in FIG. 7.
Figure 11:
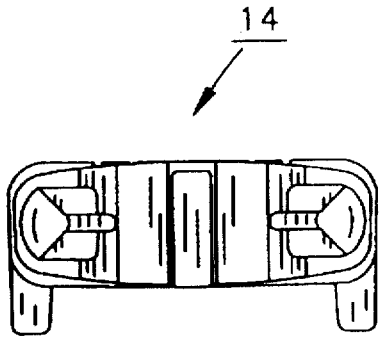
FIG. 11 is-an engagement end view of the male latch depicted in FIG. 7.
Figure 12:
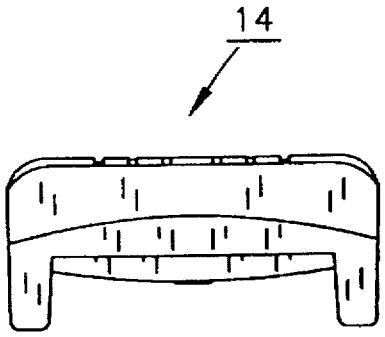
FIG. 12 is a free end view of the male latch depicted in FIG. 7.
Figure 13:
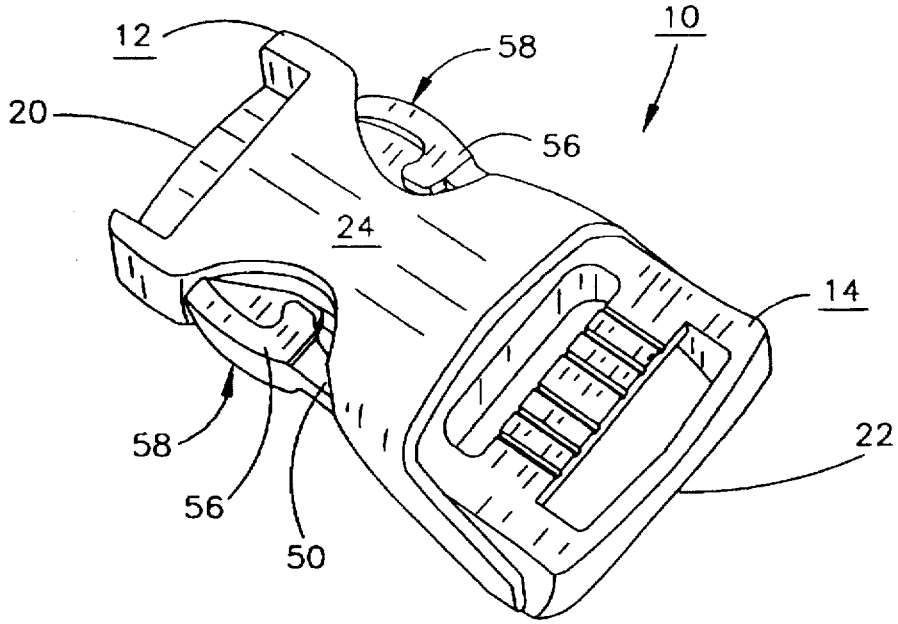
FIG. 13 is a perspective view of the female receptacle and male latch of FIGS. 1–12 engaging one another to form a buckle assembly constructed according to the present invention.
Figure 14:
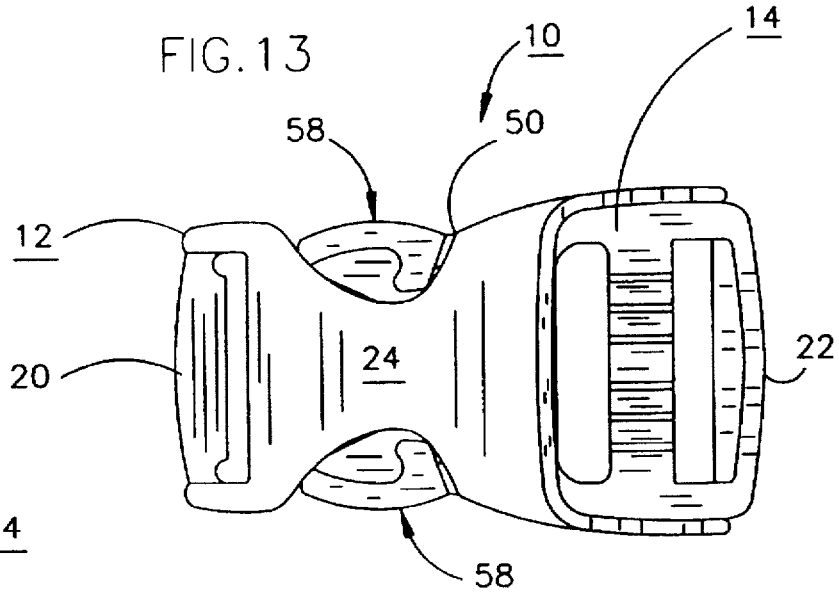
FIG. 14 is a top view of the buckle assembly shown in FIG. 13.

The interior chamber is configured to receive and releasably engage an engagement portion 58 of the male latch 14 (as shown in FIG. 8). The engagement portion 58 of the male latch 14 is inserted through the end chamber opening 30 of the female receptacle 12 into locking engagement within the interior chamber 26. Those of ordinary skill in the art will recognize various locking arrangements and configurations to facilitate a releasably engagable relationship between the female receptacle 12 and the male latch 14, such as shown in the patents mentioned above, the disclosures of which have hereby incorporated by reference.

A guide shield 32 is provided at the female engagement end 16 of the female receptacle 12 to reduce the likelihood of pinching the user's skin or clothing while attempting to direct the engagement portion 58 of the male latch 14 through the end chamber opening 30 of the female receptacle 12. Preferably, the guide shield 32 is located adjacent the end chamber opening 30 and extends outwardly from the body 24 in the direction from which the male latch 14 engages the female receptacle 12. Preferably, the guide shield 32 is an extension of a bottom wall of the body 24 wherein the body and guide shield are integrally molded to form the female receptacle. The guide shield 32 provides a guide surface 36 leading into the interior chamber 26 through the end chamber opening 30.

The guide shield 32 provides a larger effective area of contact directing the engagement portion 32 of the male latch 14 into the interior chamber 26 of the female receptacle 12. Prior art configurations having a blunt end and a flush end chamber opening reduce the effective area of initial contact leading to engagement to basically the end chamber opening 30. Missing the chamber opening on initial contact may result in jabbing the skin or clothing.

Preferably, the guide shield includes opposing sidewalls 38 extending along the sides of the guide shield 32 from sidewalls of the body 24. The sidewalls 38 and guide shield 32 form a C-shaped channel leading into the interior chamber 26 to funnel the engagement portion 58 into the interior chamber 26.

The effective area of initial contact leading into the interior chamber 26 is further increased if the guide shield extends downwardly away from the plane of engagement formed by the female receptacle 12 and the male latch 14 (as best shown in FIG. 3).

Preferably, the bottom wall 34 the body 24 and guide shield 32 have a bottom surface 40 contoured to fit the surface of the human body on which it is typically used. For example, the contour shown in FIG. 3 provides a comfortable buckle assembly suitable for a chin strap on a helmet.

In the preferred locking configuration, the body 24 also includes opposed side openings 42 extending through the body 24 into the interior chamber 26. The interior chamber includes vertical guide walls 44 running longitudinally along the length of the body 24 to form multiple engagement channels 48. The outer guide channels 48 communicate with the side openings 42. The body 24 includes locking portions 50 where the engagement channels 48 communicate with the side openings 42.

As noted, the male latch 14 includes an engagement portion 58 configured to releasably engage the interior chamber 26 and body 24 of the female receptacle 12. To form a complementary fit within the preferred female receptacle 12 disclosed above, the male latch 14 has an engagement portion 58 having two outside engagement arms 52 and a guide arm 54 parallel to and between the engagement arms 52. The engagement arms 52 and guide arm 54 slide into the outer engagement channels 46 and guide channel 48, respectively, during connection.

Figure 15:
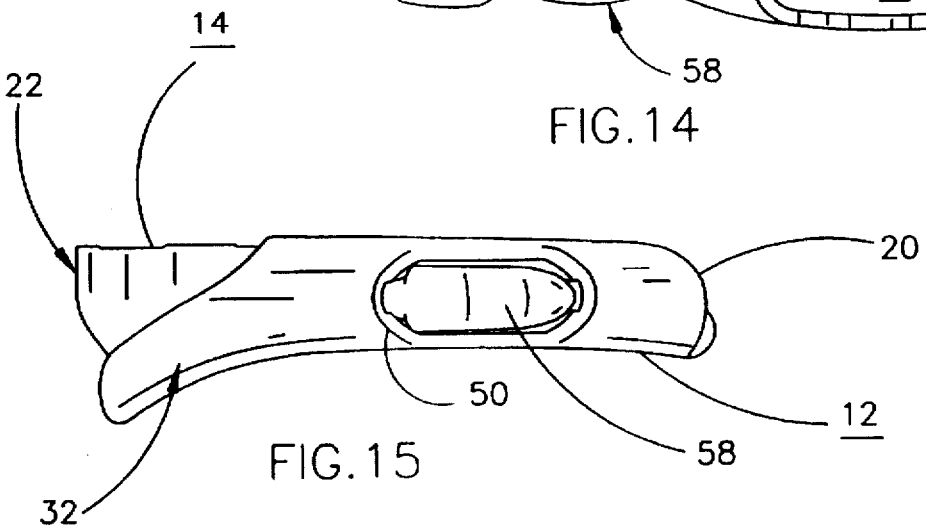
FIG. 15 is a side view of the buckle assembly shown in FIG. 13.
Figure 16:
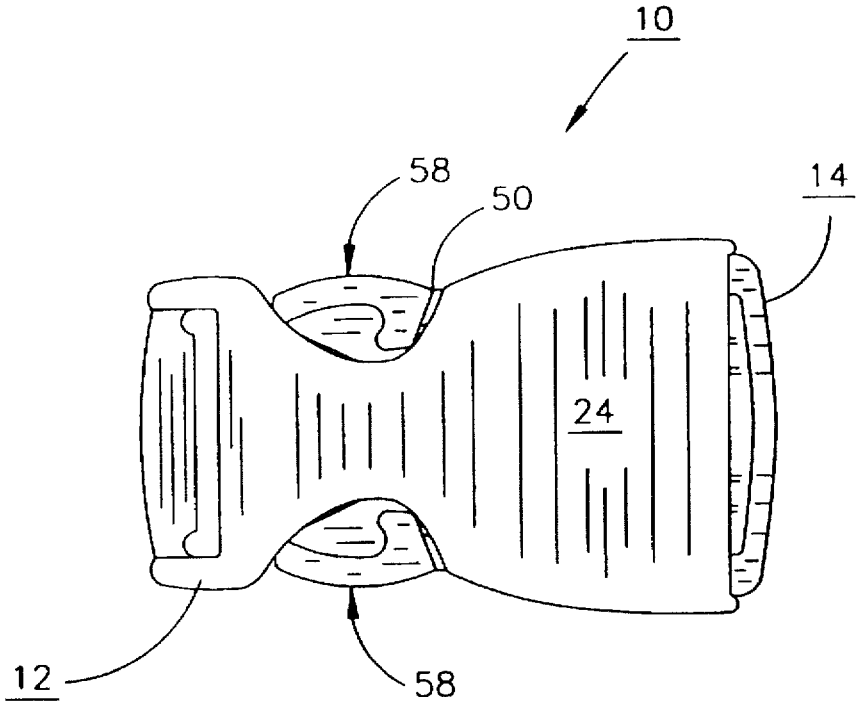
FIG. 16 is a bottom view of the buckle assembly shown in FIG. 13.
Figure 17:
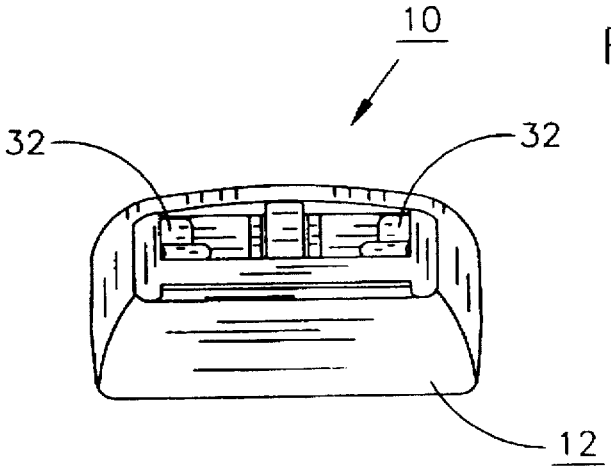
FIG. 17 is a female receptacle end view of the buckle assembly shown in FIG. 13.
Figure 18:
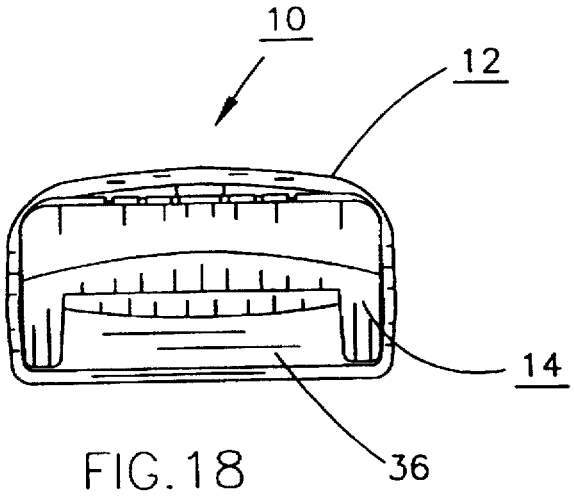
FIG. 18 is a male latch end view of the buckle assembly shown in FIG. 13.

The width of the female receptacle body 24 decreases towards the free end 20. The width of the interior chamber 26 likewise decreases thereby providing a continuously decreasing passage width through which the engagement portion 58 of the male latch 14 must travel before lockingly engaging the female receptacle 12. Thus, as the engagement portion 58 travels along the interior chamber 26, the interior sidewalls of the interior chamber 26 force the engagement arms 52 to flex inwardly toward the guide arm 54. As shown in FIG. 15 the guide shield 32 is long enough to substantially fully separate the male latch 14 from any skin or clothing under the latch when the male latch and female receptacle are engaged.

The engagement arms 52 are provided with enlarged engagement heads 56 configured to lockingly engage a locking portion 50 of the female receptacle 12 when the engagement heads 56 reach the side openings 42 of the female receptacle 12. Upon reaching the side openings, the engagement heads 56 spring outwardly from within the interior chamber 26 into the side openings 42 and engage the locking portion 50 (as shown in FIGS. 13–18).

Simultaneously pressing the engagement heads 56 inwardly towards one another at the side openings 42 releases the engagement heads 56 from the locking portions 50. Preferably, the shape of the outer portions of the engagement heads 56 and the side openings 42 are designed such that upon pressing the engagement heads 56 inward, the male latch 14 is easily ejected from within the interior chamber 26.

Certain modifications and improvements will occur to those skilled in the art upon reading of the foregoing description. By way of example, the male latch mad female receptacle may include various complimentary engagement configurations having various ways of releasing the locking engagement. The shapes of the guide shield and contours of the bodies of these may vary according to the particular application to prevent pinching and provide greater comfort. It should be understood that all such modifications and improvements have been deleted herein for the sake of conciseness and readability but are properly within the scope of the following claims.

What is claimed is:

1. A pinch resistant buckle assembly comprising:

a male latch having an outwardly extending engagement portion;

a female receptacle for said latch having:

a body and a chamber within said body with an opening at an engagement end of said body, said chamber of said female receptacle adapted to releasably engage said engagement portion of said male latch, and a guide shield adjacent said opening at said engagement end extending substantially away from said opening in a direction generally from which said male latch is inserted, said guide shield having a surface leading into said chamber and including a pair of opposed sidewalls extending from said body and adjacent said opening of said female receptacle along outer portions of said guide shield to define a C-shaped channel to guide said engagement portion of said male latch into said opening of said female receptacle;

whereby said shield inhibits pinching of any adjacent flexible material such as fabric or flesh between said engagement portion of said male latch and said body of said female receptacle while said male latch is inserted into said chamber of said female receptacle.

2. The pinch resistant buckle assembly of claim 1 wherein said guide shield extends downwardly away from a plane of engagement formed by said male latch and said female receptacle to provide an enlarged area of initial contact to guide said engagement portion of said male latch into said opening of said female receptacle.

3. The pinch resistant buckle assembly of claim 2 wherein said guide shield gradually curves downwardly away from the plane of engagement formed by said male latch and said female receptacle.

4. The pinch resistant buckle assembly of claim 1 wherein said guide shield has a lower surface contoured to fit a convex portion of a human body surface during use.

5. The pinch resistant buckle assembly of claim 1 wherein said female receptacle and said chamber have generally rectangular cross-sections, said receptacle having a bottom and two opposed sides, said bottom extending outwardly from said body to form said guide shield.

6. The pinch resistant buckle assembly of claim 1 wherein said female receptacle is integrally molded.

7. The pinch resistant buckle assembly of claim 1 wherein said female receptacle includes at least one side opening into said chamber, said engagement portion of said male latch adapted to extend into said opening from within said chamber when engaging said female receptacle, said at least one side opening providing access to depress said engagement portion to release said male latch from engagement with said female receptacle.

8. The pinch resistant buckle assembly as of claim 1 wherein said shield has a length to be coextensive with an inserted male latch to inhibit contact between said male latch and an underlying surface when engaged.

9. A pinch resistant receptacle for a buckle assembly comprising:

an integrally molded body having an interior chamber opening at an engagement end to releasably engage a mating male latch, said body having a portion adjacent said opening at said engagement end extending substantially away from said opening in a direction generally from which the male latch is to be inserted to form a guide shield, said guide shield having a surface leading into said chamber to prevent pinching between the male latch and said body of said female receptacle while inserting the latch into said chamber of said female receptacle, said guide shield including opposed side walls extending from said body adjacent said opening along outer edges of said guide shield, said side walls aiding in guiding the male latch into said chamber.

10. The pinch resistant receptacle for the buckle assembly of claim 9 wherein said guide shield extends outwardly away from said opening to provide an enlarged area of initial contact to guide said engagement portion of the latch into said opening of said female receptacle.

11. The pinch resistant receptacle for the buckle assembly of claim 10 wherein said guide shield further arches outwardly away from said opening to provide an arched surface leading into said chamber.

12. The pinch resistant receptacle for the buckle assembly of claim 9 wherein said female receptacle has an outer surface defined along said body and said guide shield, said surface forming a concave contour to increase comfort when said female receptacle is contact with a human body during use.

13. The pinch resistant receptacle for a buckle assembly of claim 9 wherein said guide shield becomes wider as said guide shield extends away from said body.

14. The pinch resistant receptacle for the buckle assembly of claim 9 wherein said receptacle includes a section opposite said opening on said body to receive a strap.

15. The pinch resistant receptacle for the buckle assembly of claim 9 wherein said receptacle body has a width, and said width generally increases towards said engagement end and said guide shield.

16. A pinch resistant receptacle for a buckle assembly comprising:

an integrally molded body having an interior chamber opening at an engagement end to releasably engage a mating male latch, said body having a portion adjacent said opening at said engagement end extending substantially away from said opening in a direction generally from which the male latch is inserted and downwardly away from a plane of engagement formed by said male latch and said female receptacle, said guide shield having a curved surface leading into said chamber to prevent pinching between the male latch and said body of said female receptacle while inserting the latch into said chamber of said female receptacle, said guide shield having opposes sides walls extending from said body adjacent said opening along outer edges of said guide shield to form a generally C-shaped guide channel.

17. A pinch resistant buckle assembly comprising:

a male latch having an outwardly extending engagement portion;

a female receptacle for said latch having:

a body and a chamber within said body with an opening at an engagement end of said body, said chamber of said female receptacle having a generally rectangular cross-section adapted to releasably engage said engagement portion of said male latch, and a guide shield adjacent said opening at said engagement end extending substantially away from said opening in a direction generally from which said male latch is inserted, said guide shield having a surface leading into said chamber and including two opposed sides extending outwardly from said body and along said guide shield to form substantially perpendicular side walls to guide said engagement portion of said male latch into said opening of said female receptacle; and whereby said shield inhibits pinching of any adjacent flexible material such as fabric or flesh between said engagement portion of said male latch and said body of said female receptacle while said male latch is inserted into said chamber of said female receptacle.

18. The pinch resistant buckle assembly of claim 17 wherein said guide shield extends downwardly away from a plane of engagement formed by said male latch and said female receptacle to provide an enlarged area of initial contact to guide said engagement portion of said male latch into said opening of said female receptacle.

19. The pinch resistant buckle assembly of claim 18 wherein said guide shield gradually curves downwardly away from the plane of engagement formed by said male latch and said female receptacle.

20. The pinch resistant buckle assembly of claim 17 wherein said guide shield has a lower surface contoured to fit a convex portion of a human body surface during use.

21. The pinch resistant buckle assembly of claim 17 wherein said female receptacle is integrally molded.

22. The pinch resistant buckle assembly of claim 17 wherein said female receptacle includes at least one side opening into said chamber, said engagement portion of said male latch adapted to extend into said opening from within said chamber when engaging said female receptacle, said at least one side opening providing access to depress said engagement portion to release said male latch from engagement with said female receptacle.

23. The pinch resistant buckle assembly as of claim 17 wherein said shield has a length to be coextensive with an inserted male latch to inhibit contact between said male latch and an underlying surface when engaged.

* * * * *